US010928764B2

(12) United States Patent
Obata et al.

(10) Patent No.: US 10,928,764 B2
(45) Date of Patent: Feb. 23, 2021

(54) IMAGE HEATING APPARATUS

(71) Applicant: CANON KABUSHIKI KAISHA, Tokyo (JP)

(72) Inventors: Seiji Obata, Mishima (JP); Kazuhiko Shinoda, Abiko (JP); Mitsugu Owada, Kasama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/548,469

(22) Filed: Aug. 22, 2019

(65) Prior Publication Data

US 2020/0073303 A1 Mar. 5, 2020

(30) Foreign Application Priority Data

Aug. 29, 2018 (JP) ..... JP2018-159950
Jul. 9, 2019 (JP) ..... JP2019-127769

(51) Int. Cl.
*G03G 15/20* (2006.01)

(52) U.S. Cl.
CPC ..... *G03G 15/2057* (2013.01)

(58) Field of Classification Search
CPC ..... G03G 15/2053
See application file for complete search history.

(56) References Cited

U.S. PATENT DOCUMENTS

2004/0007569 A1* 1/2004 Ohta ..... H05B 6/145 219/624
2015/0168889 A1* 6/2015 Kita ..... G03G 15/2039 399/33
2015/0168892 A1* 6/2015 Kuroda ..... G03G 15/2053 399/329

FOREIGN PATENT DOCUMENTS

JP H09-102385 A 4/1997
JP H11-311910 A 11/1999
JP 2002-229361 A 8/2002
JP 2003-123958 A 4/2003
JP 2016-024352 A 2/2016

* cited by examiner

*Primary Examiner* — Walter L Lindsay, Jr.
*Assistant Examiner* — Andrew V Do
(74) *Attorney, Agent, or Firm* — Venable LLP

(57) ABSTRACT

An image heating apparatus includes a cylindrical rotatable member, an exciting coil, a magnetic core, and a resin material layer provided between the exciting coil and the magnetic core. The exciting coil is a metal wire coated with heat-resistant resin. The resin material layer is provided between the exciting coil and the magnetic core and is a layer that is different from the heat-resistant resin of the metal wire. The resin material layer is provided on a surface of the magnetic core in a helical shape along the exciting coil. As viewed in a direction perpendicular to a longitudinal direction of the rotatable member, the exciting coil enters the resin material layer in a radial direction of the exciting coil.

12 Claims, 6 Drawing Sheets

IMAGE HEATING APPARATUS

CROSS-REFERENCE TO RELATED APPLICATIONS

This application claims the benefit of Japanese Patent Applications No. 2018-159950 filed on Aug. 29, 2018 and No. 2019-127769 filed on Jul. 9, 2019, which are hereby incorporated by reference herein in their entirety.

FIELD OF THE INVENTION AND RELATED ART

The present invention relates to an image heating apparatus of an electromagnetic induction heating type. The image heating apparatus is mounted in an image forming apparatus, such as a copying machine or a printer, for example, employing an electrophotographic image forming method to fix a toner image on a recording material.

A fixing unit of the electromagnetic induction heating type mounted in the printer of the astrophotography type, or the like, is known.

In Japanese Laid-Open Patent Application (JP-A) Hei 9-102385, for example, an exciting coil is directly wound around a magnetic core (magnetic core material). On the other hand, as described in JP-A 2002-22931 and illustrated in FIG. 6, an exciting coil 3 wound around a bobbin X is provided inside a fixing roller (heating roller) 1, and a magnetic core 2 is provided inside the bobbin X.

However, in the case when the exciting coil is directly wound around the magnetic core material, as in JP-A Hei 9-102385, there is a possibility that a high-frequency current supplied to the exciting coil electrically shorts out (short-circuits) through the magnetic core material and leads to breaking a high-frequency converter. Further, due to an impact (shock) or the like during transportation, there is a possibility that a winding position of the exciting coil deviates in a longitudinal direction of the magnetic core material, so that magnetic flux becomes non-uniform and resulting in difficulty uniformly heating the fixing roller with respect to the longitudinal direction.

Further, in the case when the exciting coil 3 is wound around the magnetic core material 2 through the bobbin X, there is a need to increase an outer diameter of the fixing roller 1 in consideration of a thickness of the bobbin X and clearance for the bobbin X. When the outer diameter of the fixing roller 1 increases, the energy necessary to maintain heat generation increases, and a time until the fixing roller 1 is heated to a predetermined temperature also increases, resulting in excessive electric power being needed.

SUMMARY OF THE INVENTION

A principal object of the present invention is to provide an image heating apparatus which is (i) capable of thinning an exciting means including an exciting coil and a magnetic core as seen in a direction perpendicular to a longitudinal direction of a rotatable heating member, (ii) stabilizing the exciting coil with respect to the longitudinal direction of the rotatable heating member, and (iii) avoiding a short-circuit.

According to one aspect the present invention provides an image heating apparatus for heating a toner image formed on a recording material. The image heating apparatus includes a cylindrical rotatable member including a cylindrical electroconductive layer, an exciting coil, a magnetic core, and a resin material layer. The rotatable member is rotatable while contacting the recording material. The exciting coil configured to cause the electroconductive layer to generate heat through induction heating. The exciting coil is a helix having a helical axis. The exciting coil is provided in a hollow portion of the rotatable member so that the helical axis of the exciting coil is parallel to a longitudinal direction of the rotatable member. The magnetic core is provided inside the helix of the exciting coil and configured to induce magnetic flux generated by the exciting coil. The resin material layer is provided between the exciting coil and the magnetic core. As seen in a direction perpendicular to the longitudinal direction of the rotatable member, the exciting coil enters the resin material layer in a radial direction of the exciting coil.

Further features of the present invention will become apparent from the following description of exemplary embodiments with reference to the attached drawings.

Figure 4:
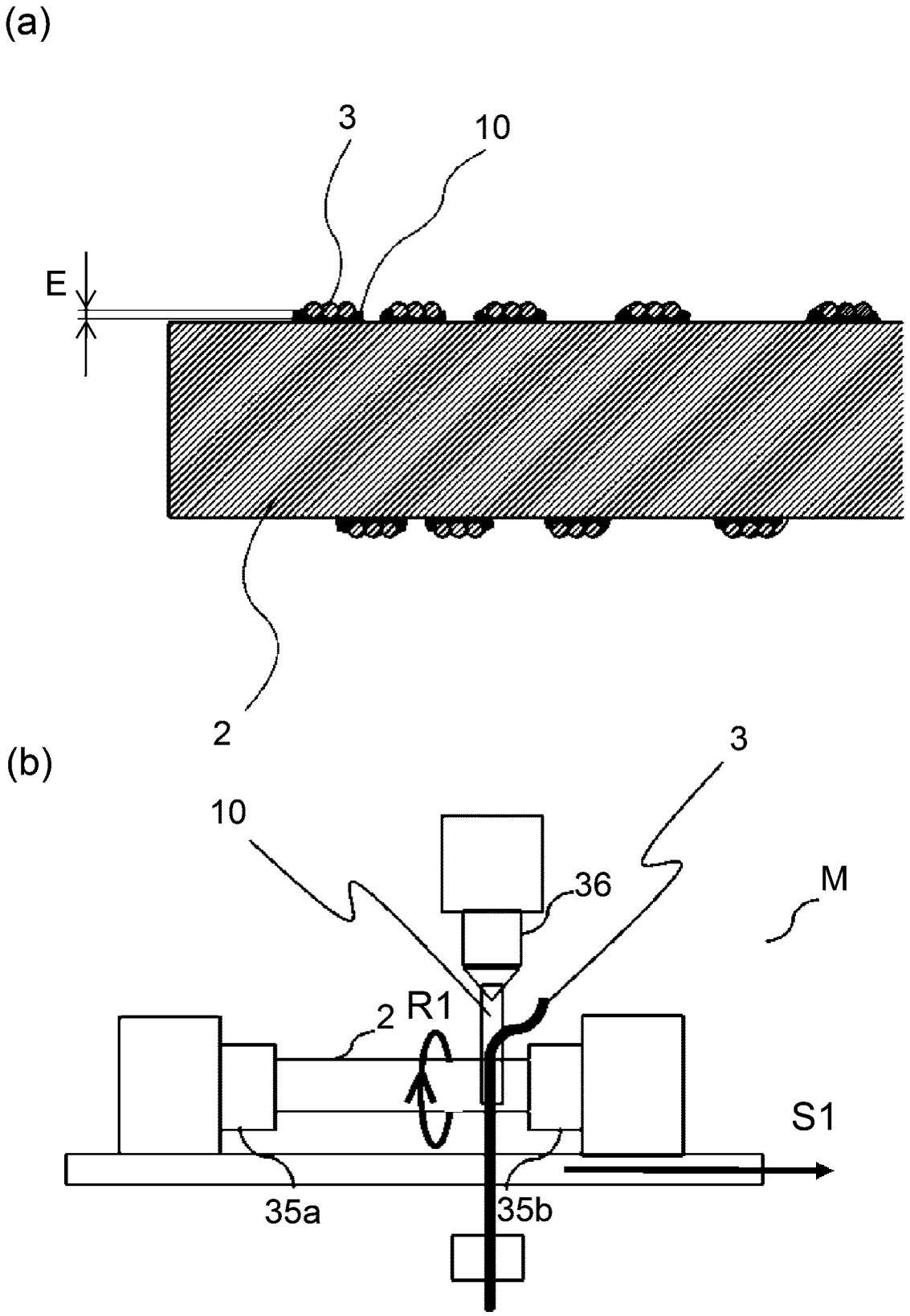

Part (a) of FIG. 4 is a sectional view of the magnetic core material around which the resin material layer and the exciting coil are wound, and part (b) of FIG. 4 is a schematic view of a manufacturing step of a coil unit.

Figure 5:
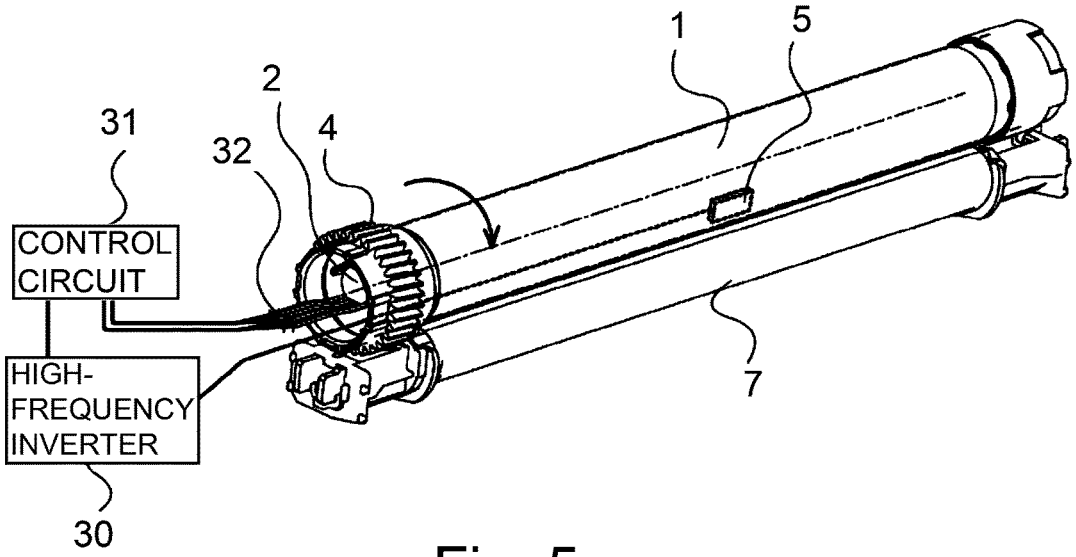

FIG. 5 is a perspective view showing a principal portion of the fixing unit.

Figure 6:
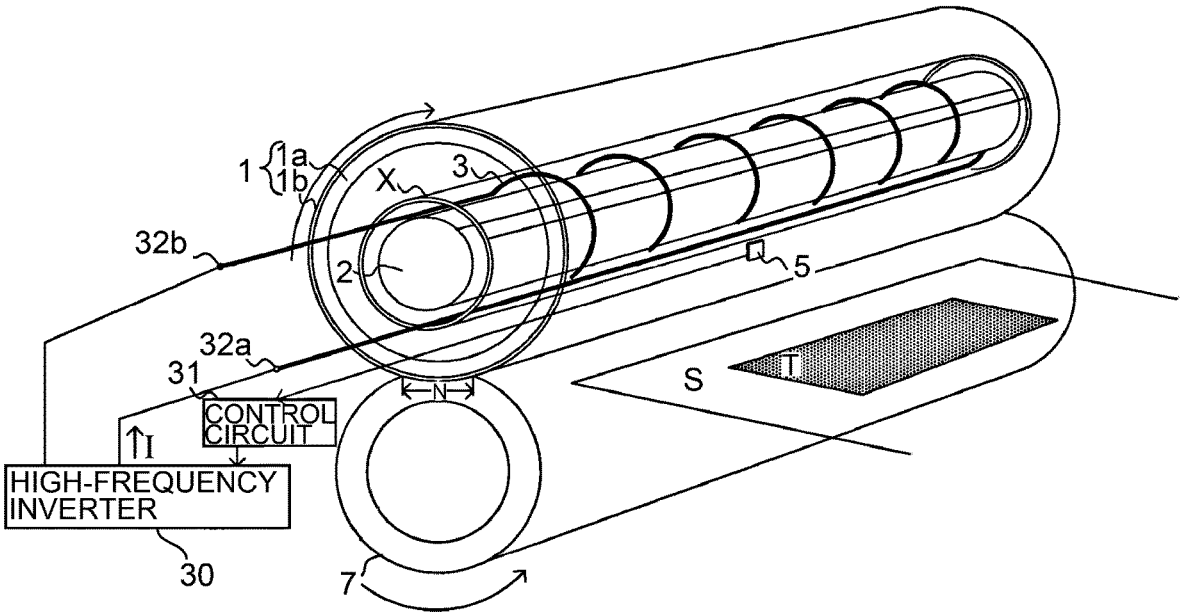

FIG. 6 is a schematic view of a conventional electromagnetic induction heating apparatus.

Figure 7:
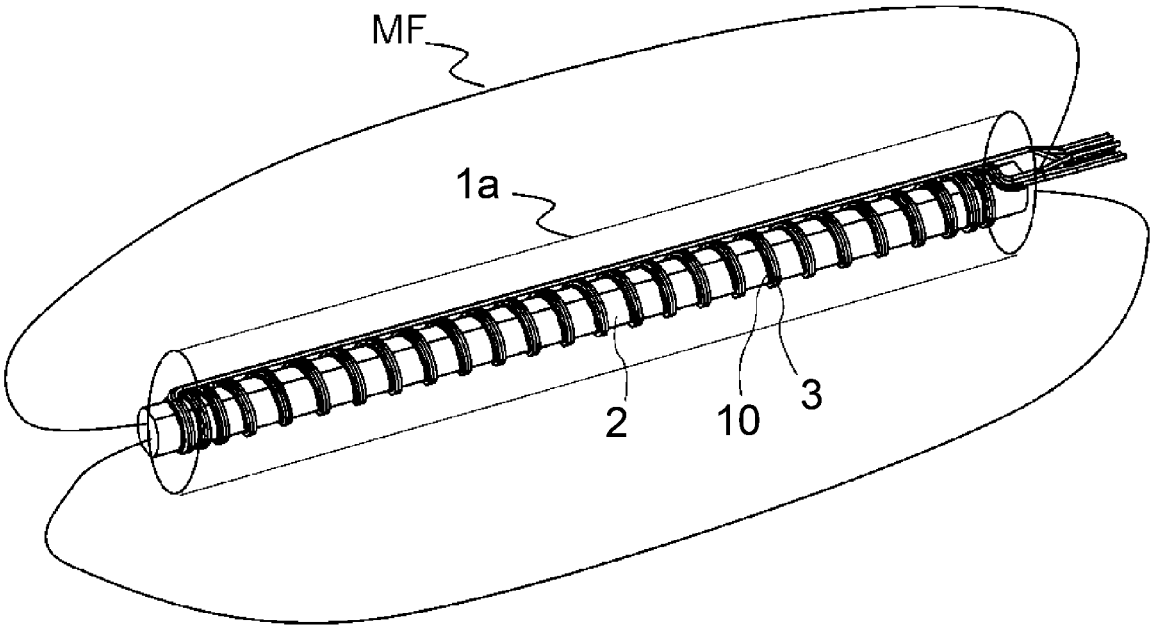

FIG. 7 is a schematic view of an electroconductive layer and a coil unit of a fixing unit of Second Embodiment.

Figure 8:
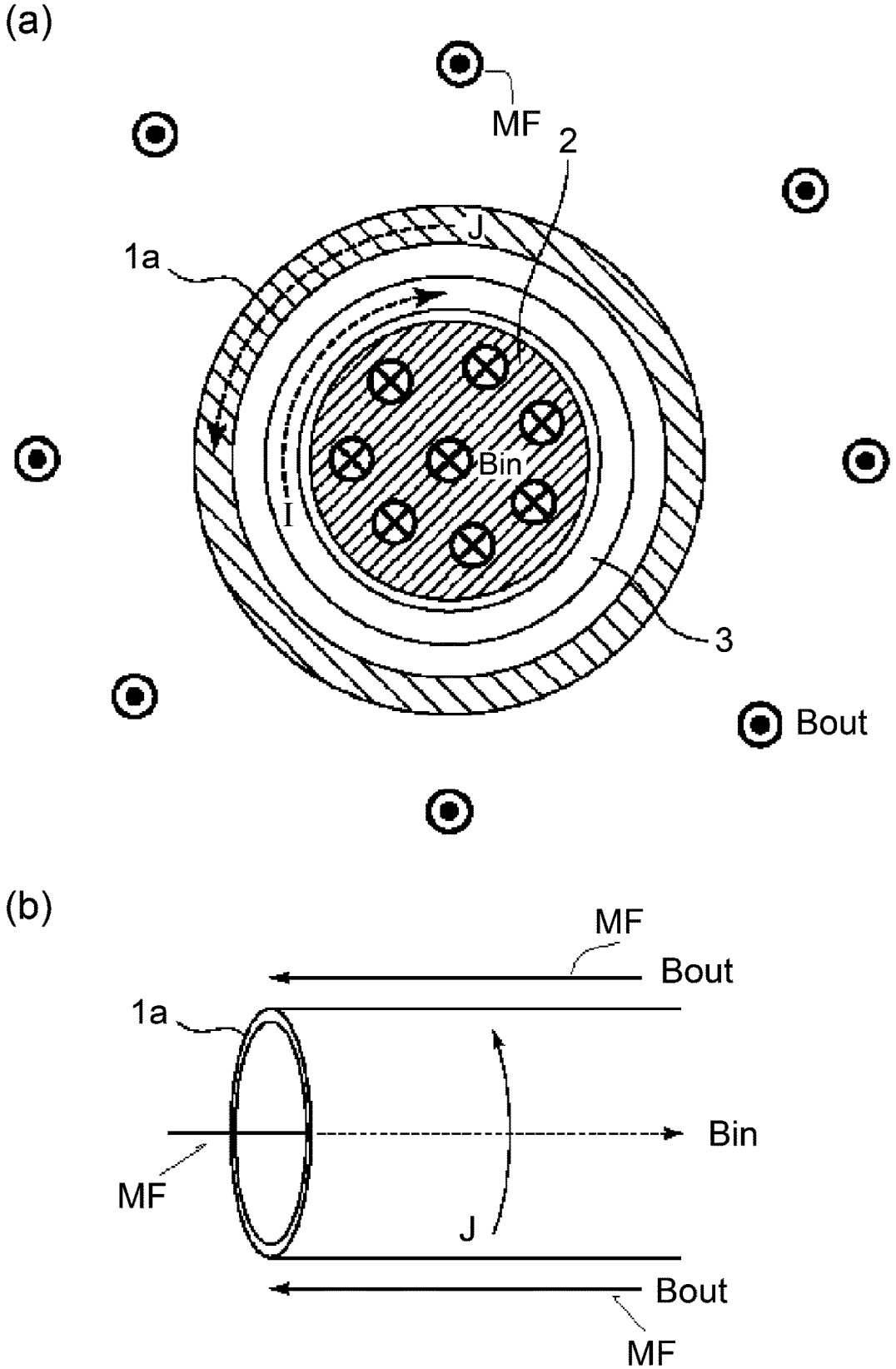

Parts (a) and (b) of FIG. 8 are schematic views of the electroconductive layer and the coil unit in Second Embodiment.

DESCRIPTION OF EMBODIMENTS

Embodiments of the present invention will be described below with reference to the drawings.

First Embodiment (Image Forming Apparatus)

Figure 1:
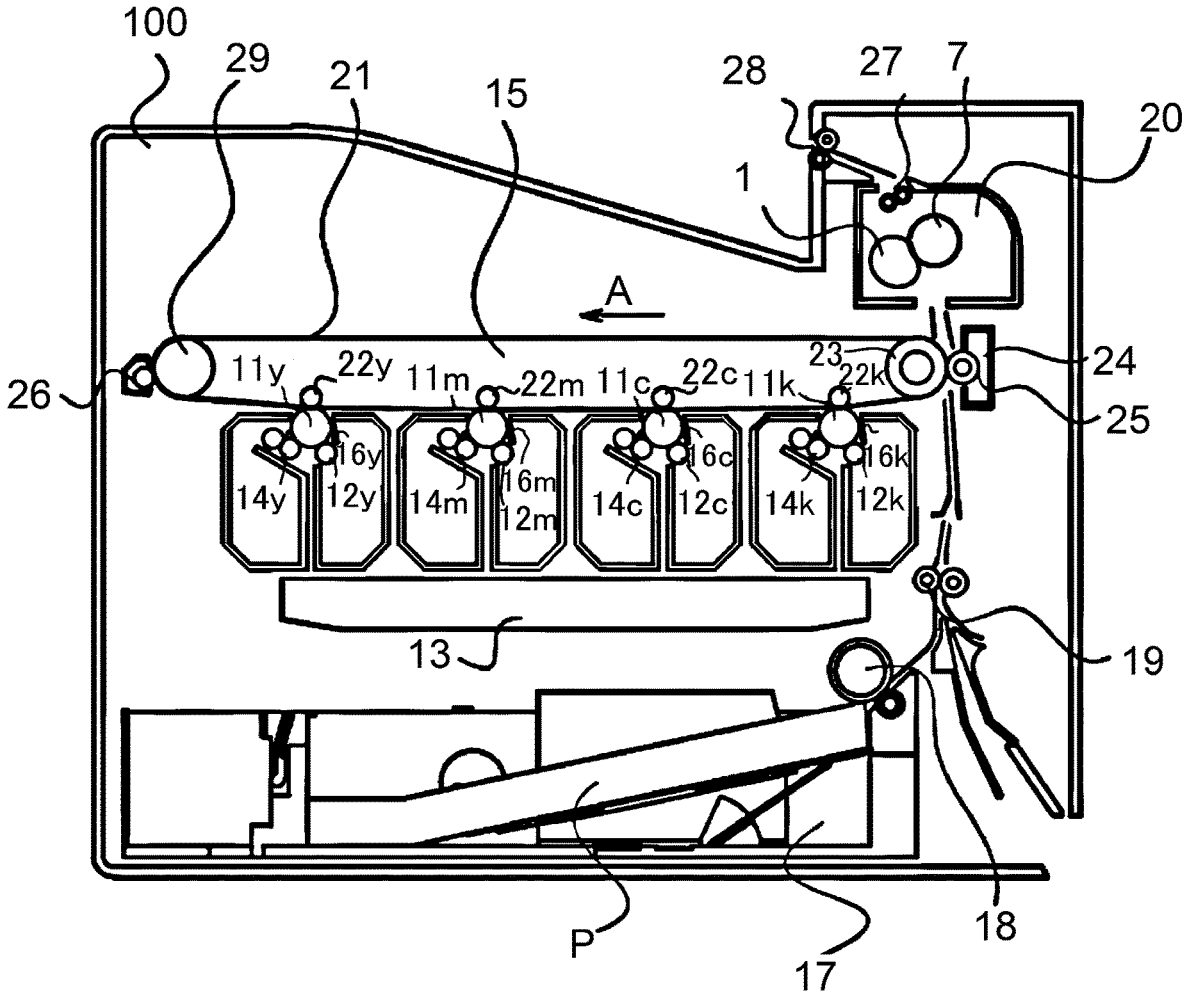
FIG. 1 is a sectional view of an image forming apparatus in which a fixing unit (image heating apparatus) of First Embodiment is mounted.

FIG. 1 is a schematic sectional view of an image forming apparatus 100 in which a fixing unit, as an image heating apparatus, according to First Embodiment of the present invention is mounted. The image forming apparatus 100 is a full-color laser beam printer of an electrophotographic type. The image forming apparatus 100 includes four photosensitive drums 11 (11*y*, 11*m*, 11*c* and 11*k*) for yellow, magenta, cyan and black, respectively. The photosensitive drum 11 is rotationally driven in the clockwise direction of FIG. 1 by unshown driving means.

Around the photosensitive drums 11, along the rotational direction thereof, are charging rollers 12 (12*y*, 12*m*, 12*c* and 12*k*) a scanner unit 13, and developing rollers 14 (14*y*, 14*m*, 14*c* and 14*k*) provided successively in the named order. The charging rollers 12 are charging means, and the scanner unit 13 is an exposure means for forming electrostatic latent images on the photosensitive drums 11. Further, cleaning blades 16 (16*y*, 16*m*, 16*c* and 16*k*) are provided for removing residual toners remaining on surfaces of the photosensitive drums 11.

Further, an intermediary transfer unit 15 is provided. Toner images on the photosensitive drums 11 are primary-transferred onto an opposing intermediary transfer belt 21 of the intermediary transfer unit 15. The intermediary transfer belt 21 is an endless belt. Further, a secondary transfer unit 24 for secondary-transferring the toner images from the intermediary transfer belt 21 onto the recording material P (secondary transfer portion) is provided downstream, with respect to a conveying (moving) direction of the intermediary transfer belt 21 (i.e., on a right(-hand) side of FIG. 1), of primary transfer portions where the intermediary transfer unit 15 contact the photosensitive drums 11.

A feeding roller 18 feeds the recording material P at an uppermost portion of a sheet feeding cassette 17 toward a registration roller pair 19. Then, the registration roller pair 19 feeds the recording material P toward the secondary transfer portion (secondary transfer unit 24) in synchronism with image positions on the intermediary transfer belt 21.

The toner images formed on the photosensitive drums 11 are superposedly transferred onto the intermediary transfer belt 21 rotating in an arrow A direction by primary transfer rollers 22 (22*y*, 22*m*, 22*c* and 22*k*) while ensuring synchronization of the image positions thereof. In this case, in a stage in which the toner images of all the colors are primary-transferred, an unfixed full-color toner image is formed on the intermediary transfer belt 21. Residual toner remaining on the respective photosensitive drums 11 after primary transfer is removed by cleaning blades 16 (16*y*, 16*m*, 16*c* and 16*k*) and stored in storing portions of cleaning devices. The full-color toner image transferred on the intermediary transfer belt 21 is transferred onto the recording material P by a secondary transfer roller 25 to which a voltage for transferring the toner image onto the recording material P is applied. A cleaner 26 for cleaning a surface of the intermediary transfer belt 21 is provided. Further, tension rollers 23 and 29 are provided inside the intermediary transfer belt 21.

The recording material P, on which the full-color toner image is transferred, is conveyed from the secondary transfer portion to a fixing unit 20. The toner image on the recording material P is fixed on the recording material P by the fixing unit 20. Thereafter, the recording material P is discharged by a feeding roller pair 27 and a discharging roller pair 28 through a discharge portion to an outside of a main assembly of the image forming apparatus in a state in which an image forming surface faces downward.

(Image Heating Apparatus)

Figure 2:
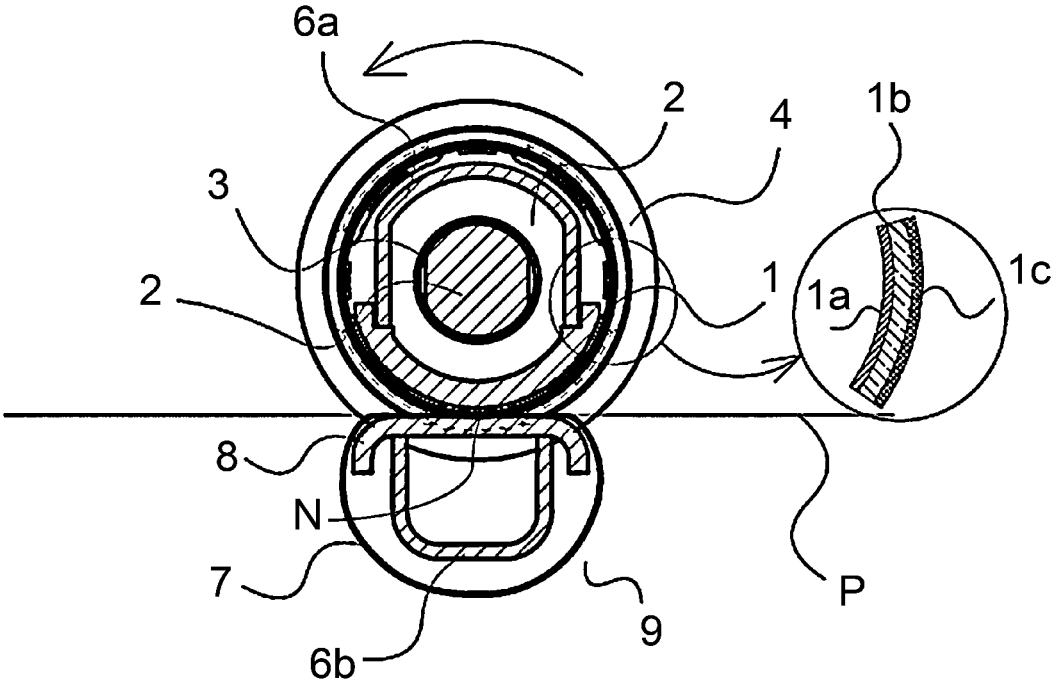
FIG. 2 is a sectional view showing a principal part of the fixing unit.

FIG. 2 is a schematic sectional view of a principal part of the fixing unit, as an image heating apparatus, according to this embodiment of the present invention. This fixing unit is an electromagnetic induction heating type.

A fixing roller 1, as a cylindrical rotatable heating member, is a hollow roller having an electroconductive layer. The electroconductive layer is constituted by a base material 1*a*, an elastic layer 1*b*, and a surface parting layer 1*c*. The base material 1*a* is formed from magnetic metal having electroconductivity, such as Ni, Cu, Cr, Fe or Co. The elastic layer 1*b* and the surface parting layer 1*c* are laminated on an outer peripheral surface of the base material 1*a* in the named order. The fixing roller 1 is supported by a frame of the fixing unit by unshown flanges.

As the base material 1*a*, for example, austenitic stainless steel (SUS) formed in a thickness of 0.1 mm-1.0 mm is used, and a material having a specific resistance value permitting sufficient heat generation through electromagnetic induction heating is selected. The elastic layer 1*b* is formed with a silicone rubber having hardness of 20 degrees (JIS-A, load: 1 kg) and has a thickness of 0.1 mm-0.8 mm. Further, the surface parting layer 1*c* is fluorine-containing resin of 10 μm-50 μm in thickness that is coated on the elastic layer 1*b*.

Figure 3:
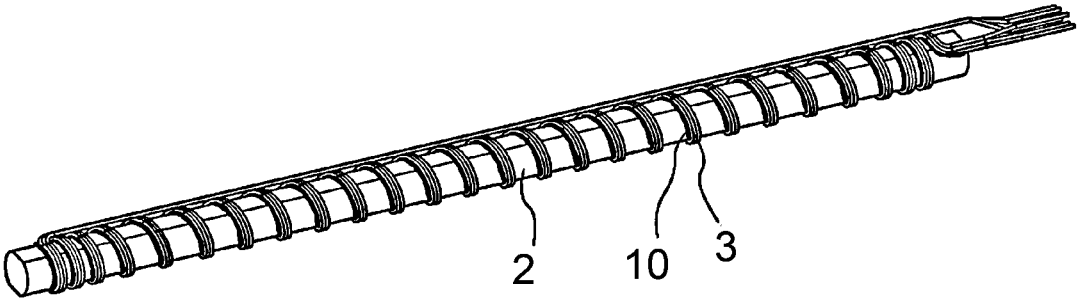
FIG. 3 is a perspective view of a magnetic core material around which a resin material layer and an exciting coil are wound.

A magnetic core material (magnetic core) 2 and an exciting coil 3, which are shown in FIG. 2, function as a magnetic field generating means (exciting means) and are inserted and disposed in a hollow portion of the fixing roller 1. Further, as shown in FIG. 3, the magnetic core 2 is provided inside the exciting coil 3 and used for inducing magnetic lines of force of an alternating magnetic field. The magnetic core 2 has a substantially cylindrical shape and is disposed at a central portion of the fixing roller 1 by an unshown fixing means.

The magnetic core 2 preferably may be formed from a material having small hysteresis loss and high relative permeability, for example, a ferromagnetic material constituted by high-permeability oxide or alloy material, such as baked ferrite, ferrite resin, amorphous alloy, permalloy or the like. Particularly, in the case when a high-frequency current in a band of 21 kHz-100 kHz is caused to flow through the exciting coil 3, the baked ferrite having small loss at the high-frequency current may preferably be used. In this embodiment, as the magnetic core 2, baked ferrite of 12 mm in diameter, 300 mm in length and 1800 in relative permeability is used. Incidentally, a shape of the magnetic core 2 is not limited to a cylindrical shape but may also be a prism shape or the like.

As the exciting coil 3, a copper wire (single load wire) coated with heat-resistant polyamideimide and having a diameter of 1 mm is used, and the exciting coil 3 is wound helically around the magnetic core 2 as shown in FIG. 3. In this embodiment, the number of winding of the exciting coil 3 is 16. In order to prevent the high-frequency current applied to the exciting coil 3 from flowing through the magnetic core 2, a resin material layer 10 is provided between the magnetic core 2 and the exciting coil 3 for maintaining an insulating relationship between the magnetic core 2 and the exciting coil 3. Further, the exciting coil 3 enters the resin material layer 10 so as to bite into the resin material layer 10, in a direction perpendicular to a longitudinal direction of the fixing roller 1, preventing the position of the winding from being deviated.

As shown in FIG. 5, a gear 4 is mounted on the fixing roller 1 at one end portion of the fixing roller 1 with respect to the longitudinal direction of the fixing roller 1. The gear 4 engages with an another gear (not shown), so that the fixing roller 1 is driven. A high-frequency converter 30 for supplying high-frequency current to the exciting coil 3, and an energization contact portion 32 are provided as shown in FIG. 5. Further, a temperature detecting element 5 (for example, a thermistor) for detecting a temperature of the fixing roller 1 is provided. In this embodiment, the temperature detecting element 5 is disposed in contact with an inner surface of the fixing roller 1 at a position corresponding to a recording material feeding inlet in the neighborhood of an upstream side of a nip N.

In FIG. 5, a control circuit 31 controls the high-frequency converter 30 on the basis of a temperature detected by the temperature detecting element 5. The exciting coil 3 is wound around the magnetic core 2 in a direction crossing an axial direction (longitudinal direction) of the fixing roller 1 as shown in FIG. 3. Further, when a high-frequency current is caused to flow through the exciting coil 3, it is possible to generate an alternating magnetic field in a direction parallel to the axial direction of the fixing roller 1. The fixing roller 1, constituted by magnetic metal, forms a main magnetic path in cooperation with the magnetic core 2, and therefore, most of magnetic flux generated by the exciting coil 3 is supplied to the magnetic metal of the fixing roller 1.

When a high-frequency magnetic field is applied to the magnetic metal, eddy current is generated, so that the fixing roller 1 itself generates heat. That is, in the fixing roller 1, eddy current is generated in the magnetic material 1*a* of the base material 1*a* by the action of a magnetic field generated by causing the high-frequency current to flow through the exciting coil 3, so that the base material 1*a* itself, i.e., the fixing roller 1 itself generates heat by Joule heat in an electromagnetic induction heating manner.

A temperature of the fixing roller 1 is detected by the temperature detecting element 5 contacting the inner surface of the fixing roller 1 and is compared with a predetermined temperature by the control circuit 31, so that output of the high-frequency converter 30 is controlled. As a result, the temperature of the fixing roller 1 is controlled to a target temperature.

A pressing unit 9, as a pressing member shown in FIG. 2, includes a pressing belt 7 and a pressing pad. The pressing belt 7 is rotated by rotation of the fixing roller 1 and nips and feeds the recording material P in cooperation with the fixing roller 1. The pressing pad 8 is provided in contact with an inner surface of the pressing belt 7 and presses the pressing belt 7 so as to form a nip N in cooperation with the fixing roller 1 between the fixing roller 1 and the pressing belt 7. The pressing pad 8 is supported by a rigid supporting member having a recessed portion and presses the pressing belt 7 from an inside of the pressing belt 7 toward the fixing roller 1.

The pressing belt 8, as an opposing member, opposes the fixing roller 1 and forms the nip N in cooperation with the fixing roller 1 so as to nip and feed the recording material P through the nip N. The pressing belt 8 may have a single layer structure, but in this embodiment, a belt having a lamination layer structure in which a parting layer is formed on a surface of a base material is used. A resin (material) base material, which has a heat-resistant property and which is made of, for example, thermosetting polyimide, thermoplastic polyimide, polyamide, polyamideimide or the like, is used as the base material of the pressing belt 7.

Further, a layer having a good parting property from the toner to be deposited on the surface of the pressing belt 7 may preferably be used as the parting layer of the pressing belt 7. A fluorine-containing resin material such as PTFE (polytetrafluoroethylene) or PFA (tetrafluoroethylene-perfluoroalkyl vinyl ether copolymer) is used, for example, as a material of the parting layer. In this embodiment, the pressing belt 7 is a pressing belt in which polyimide is used as the base material and PFA is used as the material of the parting layer.

The pressing pad 8 functions as a back-up member for forming the nip N between the fixing roller 1 and the pressing belt 7, and a high-rigidity material comprising metal or metal alloy, such as aluminum, stainless steel, steel, copper or brass, or a resin material, for example, is principally used as a material of the pressing pad 8. In this embodiment, a resin material prepared by injection molding of a liquid crystal polymer reinforced with glass is used. For that reason, proper rigidity can be realized along a widthwise direction of the nip N. The nip N having a predetermined width is formed between the pressing unit 9 and the fixing roller 1.

Then, the fixing roller 1 and the pressing belt 7 are rotated, and in a state in which the fixing roller 1 is heated by electromagnetic induction heating and is temperature-controlled to a predetermined temperature, the recording material P on which the unfixed toner image is transferred is introduced in the nip N. Further, the recording material P is nipped and fed in the nip N, so that the unfixed toner image is heated and melted by heat of the fixing roller 1 and pressure from the pressing unit 9 and is thus heat-fixed on the recording material P by being interfused in the surface of the recording material P.

(Resin Material Layer Provided Between Exciting Coil and Magnetic Core)

1) Manufacturing Step Including Winding of Exciting Coil and Resin Material Layer Around Magnetic Core As a step of manufacturing the fixing unit, a step of winding the exciting coil 3 and the resin material layer 10 around the magnetic core 2 will be described first. In the step of winding the exciting coil 3 and the resin material layer 10 around the magnetic core 2, a coil winding tool M, shown in part (b) of FIG. 4, for helically winding the exciting coil 3 and the resin material layer 10 around the magnetic core 2 is used.

First, opposite end portions of the magnetic core 2 with respect to a longitudinal direction are chucked by holding members 35*a* and 35*b* of the coil winding tool M. Above one end portion of the magnetic core 2, a molding machine 36 from which a resin material is extruded is provided, and the resin material is molded on the magnetic core 2 at a predetermined position.

Thereafter, the magnetic core 2 is rotated in an R1 direction by a driving means of the coil winding tool M, so that the exciting coil 3 is co-wound together with the molded resin material 10 around the magnetic core 2 so as to be superposed on the molded resin material 10. At that time, the magnetic core 2 fixed by the holding members 35*a* and 35*b* moves in a longitudinal direction Si of the magnetic core 2 while rotating in the R1 direction. As a result, the exciting coil 3 is helically wound together with the molded resin material 10 around the magnetic core 2. As a result, the resin material 10 is provided between the magnetic core 2 and the exciting coil 3.

The wound exciting coil 3 is required to be accurately wound around the magnetic core 2 at a predetermined position so that the fixing roller 1 uniformly generates heat. In this embodiment, with respect to the longitudinal direction of the magnetic core 2, the exciting coil 3 was wounded within a range of a tolerance of ±0.3 mm.

Further, the exciting coil 3 is wound around the resin material layer 10, which is not sufficiently solidified immediately after extrusion molding, so that the exciting coil 3 is in a state in which the exciting coil 3 bites into the resin material layer 10. Thereafter, the resin material of the resin material layer 10 is solidified while being cooled and thus fixedly holds the exciting coil 3. In this way, a constitution in which the exciting coil 3 is wound around the resin material layer 10 while being fixed to the resin material layer 10 so as to enter the resin material layer 10 is realized. In this embodiment, as shown in part (a) of FIG. 4, the exciting coil 3 of 1.0 mm in diameter is wound around the resin material layer 10 so as to bite into the resin material layer 10 in a depth E=0.5 mm.

As a result, the position of the exciting coil 3 once wound around the resin material layer 10 is fixed by the resin material of the resin material layer 10 and thus deviation of the position of the exciting coil 3 due to impact (shock) or the like after fixing can be eliminated, so that uniform heat generation of the fixing roller 1 can be maintained. Incidentally, the cooled resin material layer 10 is in a state in which the resin material layer 10 is bonded to both the magnetic core 2 and the exciting coil 3.

2) Effect of this Embodiment

By the above-described manufacturing step, it becomes possible to decrease outer diameters of component parts inserted and incorporated in the fixing roller 1 and an outer diameter of the fixing roller 1 and to make heat capacity small, therefore, saving energy when the fixing roller 1 generates heat. In this embodiment, a polyphenylene sulfide (PPS) resin material that is excellent in heat-resistant property and extrusion molding property is used as the resin material for the extrusion molding. Further, the magnetic core 2 is made of ceramics, such as ferrite, prepared by baking an inorganic substance, and therefore, is a component part which is liable to broken because of impact (shock), but is strengthened against breakage by bringing the resin material layer into intimate contact with the magnetic core 2.

Further, as shown in FIG. 3, the exciting coil 3 and the resin material layer 10 are helically wound around the magnetic core 2 so that a pair of the exciting coil 3 and the resin material layer 10 is spaced from an adjacent pair of the exciting coil 3 and the resin material layer 10. For this reason, a constitution in which the magnetic core 2 is exposed between adjacent exciting coils 3 is employed. That is, similarly as in the case of the exciting coil 3, the resin material layer 10 is also helically wound around the magnetic core 2. As a result, temperature rise can be suppressed compared with the constitution in which an entirety of the magnetic core 2 is coated with a resin material layer.

A saturation temperature of the baked ferrite used in this embodiment was 165° C., but the constitution of this embodiment, the baked ferrite can be used at a temperature not more than the saturation temperature, so that the fixing roller 1 can be caused to generate heat through induction heating.

As described above, according to this embodiment, a constitution in which the resin material layer intimately contacting the magnetic core and the exciting coil is provided between the magnetic core and the exciting coil and in which the exciting coil is configured to enter the resin material layer in a radial direction of the magnetic core is employed, so that deviation in position of the exciting coil is prevented and thus the fixing roller can be caused to generate heat uniformly. Further, by providing the resin material layer so as to intimately contact each of the magnetic core and the exciting coil, the outer diameters of the component parts inserted in the fixing roller are decreased, and thus the outer diameter of the fixing roller can be decreased. As a result, heat capacity of the fixing roller is lowered, so that it is possible to realize shortening of a warm-up time and reduction of electric power consumption.

Further, as regards the magnetic core, which is liable to be broken against the impact, it is possible to prevent breakage of the magnetic core by intimate contact of the resin material layer with the magnetic core. Further, by providing the resin material layer only in a region where the exciting coil is wound around the magnetic core, the magnetic core is exposed partially, so that temperature rise of the magnetic core is suppressed and thus the fixing roller can be caused to uniformly generate heat at a temperature not more than a magnetic saturation temperature. As a result, it is possible to provide an image heating apparatus capable of uniformly generating heat while saving energy.

Second Embodiment

FIG. 7 and parts (a) and (b) of FIG. 8 show an electroconductive layer and a coil unit of a fixing unit of a second embodiment. In the embodiment shown in FIGS. 7 and 8, structures of an exciting coil 3, a magnetic core 2 and a resin material layer 10 provided between the exciting coil 3 and the magnetic core 2 are the same as those in FIG. 3. However, in this embodiment, a material of an electroconductive layer 1*a* is aluminum having relative permeability of 1, and a thickness of the electroconductive layer 1*a* is 20 μm-100 μm. The material of the electroconductive layer 1*a* may also be a non-magnetic material such as copper (Cu) or silver (Ag) or a feebly-magnetic material such as stainless steel (SUS).

The exciting coil 2 has a non-endless shape. Further, as shown in FIG. 7 and parts (a) and (b) of FIG. 8, a constitution in which magnetic flux MF which is generated by causing an alternating current I to pass through the exciting coil 3 and which comes out of opposite ends of the magnetic core 2 passes through an outside of the electroconductive layer 1*a* is employed. In FIG. 7, only two magnetic fluxes MF are shown, but in actuality, an infinite number of magnetic fluxes are generated. The material of the electroconductive layer 1*a* is aluminum, and therefore, the magnetic fluxes coming out of the opposite ends of the magnetic core 2 do not readily enter a range of the thickness of the electroconductive layer 1*a*.

In parts (a) and (b) of FIG. 8, the magnetic flux MF passing through an inside of the magnetic core 2 is represented by Bin. The magnetic flux Bin moves from a front surface side toward a back surface side of the drawing sheet of part (a) of FIG. 8. On the other hand, the magnetic flux MF passing through the outside of the electroconductive layer 1*a* is represented by Bout. The magnetic flux Bout moves from the back surface side toward the front surface side of the drawing sheet of part (a) of FIG. 8. In the example of part (a) of FIG. 8, eight magnetic fluxes Bin and eight magnetic fluxes Bout are illustrated, and part (b) of FIG. 8 shows that all the magnetic fluxes passing through the inside of the electroconductive layer pass through the outside of the electroconductive layer 1*a*. A constitution in which at least 90% in number of the magnetic fluxes Bin passing through the inside of the magnetic core 2 pass through the outside of the electroconductive layer 1*a* may preferably be employed in terms of energy efficiency of the fixing unit.

When an alternating magnetic field is formed in actuality, an induced electromotive force is exerted on the electroconductive layer 1*a* in an entire region with respect to a circumferential direction so as to cancel the magnetic fluxes to be formed as shown in FIG. 7 and parts (a) and (b) of FIG. 8, so that a current I is induced in the circumferential direction. In actuality, the current I is an alternating current, so that a direction of the induced current J also changes correspondingly to a change in direction of the current I. When the current flows through the electroconductive layer 1*a*, the electroconductive layer 1*a* is made of metal, so that Joule heat generation is caused by electric resistance. Incidentally, the direction of the induced current J is the same in an entire region of the electroconductive layer 1*a* with respect to the thickness direction.

In this embodiment, a constitution in which the fixing unit having the constitution in which most of the magnetic fluxes MF coming out of the opposite ends of the magnetic core 2 pass through the outside of the electroconductive layer 1*a* includes the exciting coil 3, the magnetic core 2, and the resin material layer 10 provided between the exciting coil 3 and the magnetic core 2 as shown in FIG. 3 is employed. As a result, it is possible to provide the fixing unit by which electric power consumption is suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image heating apparatus for heating a toner image formed on a recording material, the image heating apparatus comprising:

a cylindrical rotatable member including a cylindrical electroconductive layer, said rotatable member being rotatable while contacting the recording material and having a longitudinal direction;

an exciting coil configured to cause said electroconductive layer to generate heat through induction heating, said exciting coil being (i) a helix having a helical axis and (ii) a metal wire coated with heat-resistant resin, said exciting coil being provided in a hollow portion of said rotatable member so that the helical axis of said exciting coil is parallel to the longitudinal direction of said rotatable member;

a magnetic core provided inside the helix of said exciting coil and configured to induce magnetic flux generated by said exciting coil; and a resin material layer provided between said exciting coil and said magnetic core, said resin material layer being a layer different from the heat-resistant resin of said metal wire, said resin material layer being provided on a surface of said magnetic core in a helical shape along said exciting coil, wherein, in a plane parallel to the longitudinal direction of said rotatable member and cutting said magnetic core and said exciting coil, said resin material layer includes a recessed portion, and said exciting coil enters the recessed portion of said resin material layer in a radial direction of said magnetic core as viewed in a direction perpendicular to the longitudinal direction of said rotatable member.

2. The image heating apparatus according to claim 1, wherein, in a region other than a region where said exciting coil is wound around said magnetic core, said resin material layer is absent on a surface of said magnetic core and said magnetic core is exposed.

3. The image heating apparatus according to claim 1, wherein, said resin material layer is polyphenylene sulfide resin.

4. The image heating apparatus according to claim 1, wherein said magnetic core has a non-endless shape and magnetic flux coming out of opposite ends of said magnetic core passes through an outside of said electroconductive layer.

5. The image heating apparatus according to claim 4, wherein ninety percent or more of the magnetic flux passing through an inside of the magnetic core passes through the outside of said electroconductive layer.

6. The image heating apparatus according to claim 1, wherein said exciting coil is formed by a plurality of said metal wires, and wherein said resin material layer includes a plurality of the recessed portions corresponding to the plurality of said metal wires, respectively.

7. The image heating apparatus according to claim 1, wherein said exciting coil is formed by a plurality of said metal wires, and wherein respective distances between the plurality of said metal wires and said magnetic core are substantially the same.

8. An image heating apparatus for heating a toner image formed on a recording material, the image heating apparatus comprising:

a cylindrical rotatable member including a cylindrical electroconductive layer, said rotatable member being rotatable while contacting the recording material and having a longitudinal direction;

an exciting coil configured to cause said electroconductive layer to generate heat through induction heating, said exciting coil being (i) a helix having a helical axis and (ii) a metal wire coated with heat-resistant resin, said exciting coil being provided in a hollow portion of said rotatable member so that the helical axis of said exciting coil is parallel to the longitudinal direction of said rotatable member;

a magnetic core provided inside the helix of said exciting coil and configured to induce magnetic flux generated by said exciting coil; and a resin material layer provided between said exciting coil and said magnetic core, said resin material layer being a layer different from the heat-resistant resin of said metal wire, said resin material layer being provided on a surface of said magnetic core in a helical shape along said exciting coil, wherein, in a region other than a region where said exciting coil is wound around said magnetic core, said resin material layer is absent on a surface of said magnetic core and said magnetic core is exposed.

9. The image heating apparatus according to claim 8, wherein said resin material layer is polyphenylene sulfide resin.

10. The image heating apparatus according to claim 8, wherein said magnetic core has a non-endless shape and magnetic flux coming out of opposite ends of said magnetic core passes through an outside of said electroconductive layer.

11. The image heating apparatus according to claim 10, wherein ninety percent or more of the magnetic flux passing through an inside of the magnetic core passes through the outside of said electroconductive layer.

12. The image heating apparatus according to claim 8, wherein said exciting coil is formed by a plurality of said metal wires, and wherein respective distances between the plurality of said metal wires and said magnetic core are substantially the same.

* * * * *